United States Patent [19]

Murasaki

[11] Patent Number: 4,736,899

[45] Date of Patent: Apr. 12, 1988

[54] MOBILE APPARATUS FOR REELING SURFACE TYPE FASTENER TAPES OR LIKE ELONGATE STRIPS OR FLEXIBLE MATERIAL

[75] Inventor: Ryuichi Murasaki, Toyama, Japan

[73] Assignee: Yoshida Kogyo K. K., Tokyo, Japan

[21] Appl. No.: 947,172

[22] Filed: Dec. 29, 1986

[30] Foreign Application Priority Data

Dec. 28, 1985 [JP] Japan ..... 60-298078

[51] Int. Cl.[4] ..... B65H 18/16

[52] U.S. Cl. ..... 242/67.1 R; 242/86.5 R; 242/105

[58] Field of Search ..... 242/67.1 R, 86.52, 86.63, 242/86.64, 86.7, 99, 55, 68.7, 66, 78, 78.1, 105, 180, 193

[56] References Cited

U.S. PATENT DOCUMENTS

| | | | |
|---|---|---|---|
| 3,224,705 | 9/1963 | Nash | 242/105 |
| 3,835,571 | 9/1974 | Berry | 242/99 X |
| 4,542,864 | 9/1985 | Hart | 242/193 |

*Primary Examiner*—John M. Jillions
*Assistant Examiner*—Steven M. Dubois
*Attorney, Agent, or Firm*—Hill, Van Santen, Steadman & Simpson

[57] ABSTRACT

At least one, preferably two or more, reels are coaxially mounted on a carriage such as a handcart for rotation independently of each other in order to wind surface type fastener tapes or like strips to be transported from one processing station to another. Disposed in a preassigned position, a driving and braking mechanism comprises a plurality of carrier arms each medially pivoted on a fixed support for oscillation about an axis parallel to the axis of the reels. Each carrier arm has a drive roll and a brake mounted on its opposite ends. As the carrier arm is oscillated as by a fluid actuated cylinder, the drive roll and the brake roll are alternately movable into and out of frictional engagement with the periphery of the flange of one associated reel. Thus, for winding one or more strips on one or more reels, the associated carrier arm or arms may be swung in a direction required to move the drive roll or rolls thereon into driving engagement with the reel or reels. The rotation of the reel or reels can be arrested upon completion of the winding by swinging the carrier arm or arms in the opposite direction, since then the associated brake or brakes move into frictional engagement with the reel or reels.

9 Claims, 4 Drawing Sheets

MOBILE APPARATUS FOR REELING SURFACE TYPE FASTENER TAPES OR LIKE ELONGATE STRIPS OR FLEXIBLE MATERIAL

BACKGROUND OF THE INVENTION

This invention relates to apparatus for winding on a reel or reels any such elongate strips of flexible material as type fastener tapes, slide fastener chains, clothing tapes, etc. More specifically, the invention pertains to such reeling apparatus which may include a carriage such as a handcart on which a desired strip or strips can be reeled, thereby expediting the transportation of the reeled strip or strips from one processing station to another during the manufacture of desired products from the strip or strips.

The surface type fastener is known which comprises one fastener member having a mulplicity of hooks on a piece of carrier fabric, and another fastener member having a multiplicity of loops on another piece of carrier fabric. When pressed against each other, the two fastener members fasten together as a result of the interengagement of the hooks and loops. The hooks and loops are disengageable when the fastener members are forced apart. In the manufacture of such surface type fasteners, fastener tapes are prepared which are elongate strips of carrier fabric each having hooks or loops on its front side. The rear sides of these fastener tapes must be coated with a fluid material that, on being set thermally, can provide a positive anchorage for the hooks or loops onto the carrier fabric against the possibility of detachment in use. After the thermal setting of the coatings, the fastener tapes are reeled for transportation to a cutting station, where the tapes are cut into required lengths.

The usual conventional practice in the fastener industry has been to wind the fastener tapes, which have had their coatings thermally cured, on reels and then to load these reels on any carriage or conveyor means for transportation to the cutting station. As far as the applicant is aware, no means have so far been available for reeling the fastener tapes directly on the carriage or conveyor means.

SUMMARY OF THE INVENTION

The present invention provides an improved apparatus whereby a strip or strips of flexible material can be reeled directly on a desired carriage or conveyor means, for ready transportation to any desired destination.

Stated broadly, the reeling apparatus in accordance with the invention comprises a reel having a flange formed on at least one end of a cylindrical core. For driving and braking the reel via its flange, a carrier arm is provided which is pivoted at a midpoint thereof for oscillation about an axis parallel to the reel axis. The carrier arm carries on its opposite ends a drive roll, which rotates about an axis parallel to the reel axis by being driven as by an electric motor, and a brake. An actuator is provided for bidirectionally swinging the carrier arm. Upon swinging of the carrier arm in one direction, the drive roll is moved into driving engagement with the periphery of the reel flange. The strip can be wound on the reel being thus driven by the drive roll. The carrier arm may be swung in the opposite direction upon completion of the winding, whereupon the brake is moved into frictional engagement with the reel flange for immediately arresting the rotation of the reel.

Preferably, the reel is rotatably mounted on a suitable carriage for directly winding the strip thereon and, upon completion of the winding, for immediately transporting the reeled strip to a desired location. A driving and braking mechanism, comprising the pivotal carrier arm carrying the drive roll and brake, may be disposed in a fixed position where the strip is to be reeled. When the reel is mounted on a carriage, a locking mechanism is needed for holding the carriage in position with respect to the driving and braking mechanism during the reeling of the strip.

According to a further feature of the invention, a plurality of reels may be mounted coaxially on the carriage for independent rotation. The driving and braking mechanism is readily adaptable, as disclosed herein, for individually driving and braking the reels. Two or more strips can thus be wound simultaneously on the desired reels on the carriage by driving and braking only the required reels.

The above and other features and advantages of this invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

General

Figure 1:
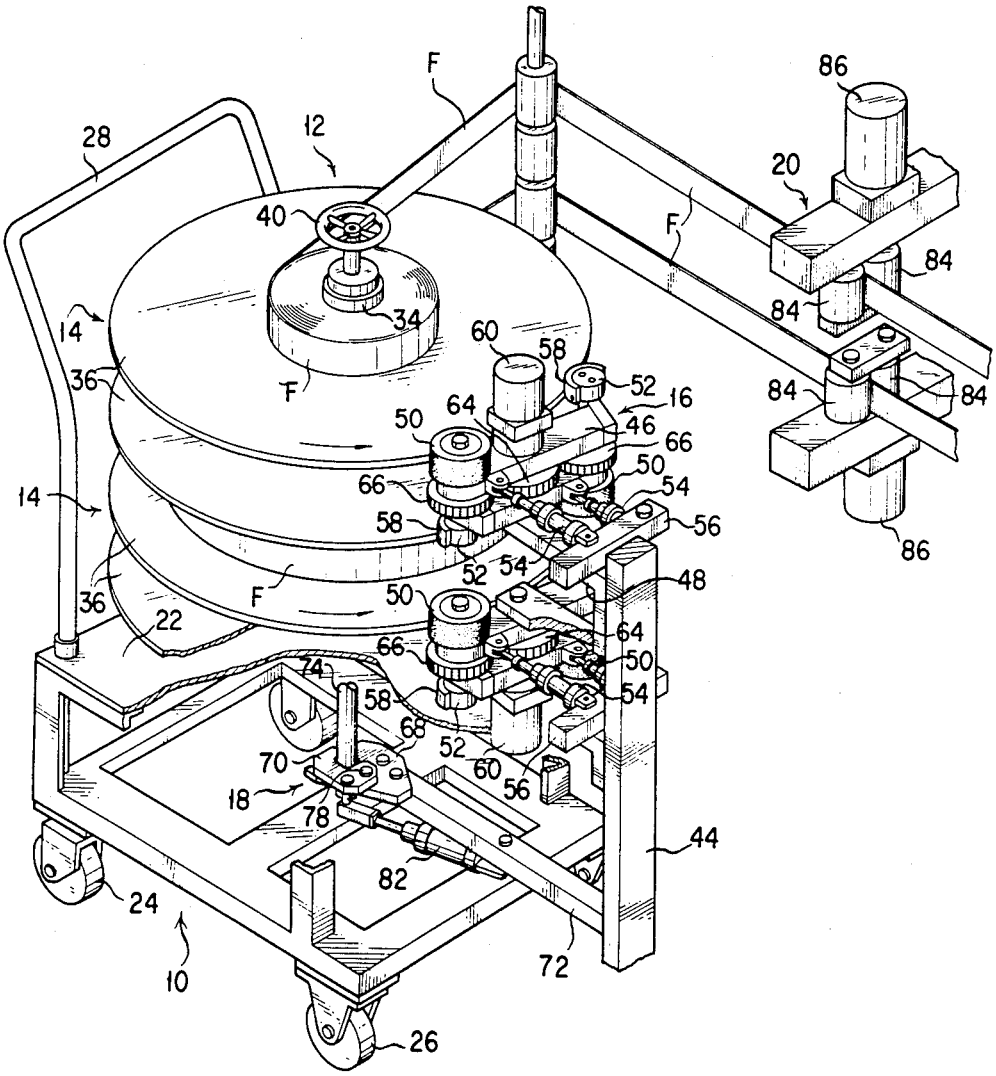
FIG. 1 is a perspective view, with parts shown broken away to reveal other parts, of the mobile apparatus for simultaneously reeling a plurality of elongate strips of flexible material in accordance with the invention.
Figure 2:
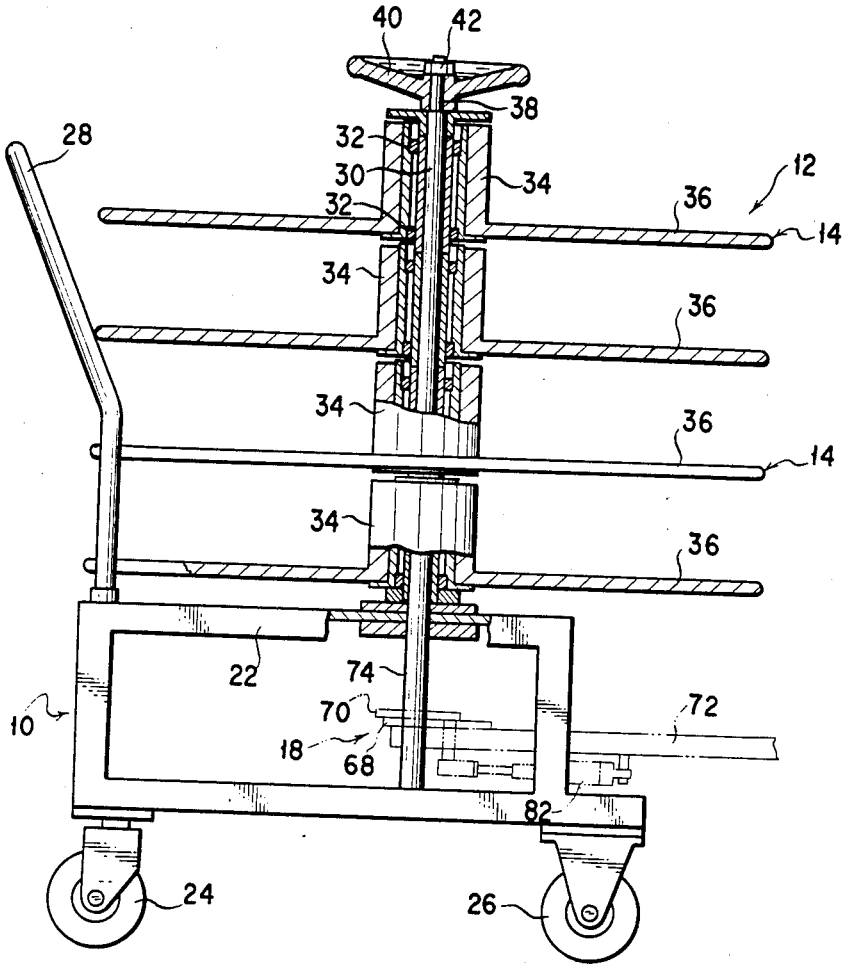
FIG. 2 is an elevation, partly shown broken away and partly sectioned for clarity, of the carriage, together with the reel assembly mounted thereon, of the apparatus of FIG. 1.

The apparatus of this invention will now be described in detail as adapted for reeling a plurality of surface type fastener tapes that have had their coatings cured thermally, preparatory to transportation to a cutting station where the tapes are to be cut into required lengths. At 10 in FIGS. 1 and 2 is shown a carriage such as a handcart for the conveyance of the reeled fastener tapes F from one processing station to the next. The handcart 10 has mounted thereon a reel assembly 12 comprising a plurality of, four in this particular embodiment, reels 14 coaxially stacked one on top of another for winding the fastener tapes F.

FIG. 1 further shows a driving and braking mechanism 16 disposed in a preassigned position where the fastener tapes F are to be wound on the reels 14 on the handcart 10. As the name implies, the driving and braking mechanism 16 serves the dual purpose of individually driving the reels 14 for winding the fastener tapes F thereon and, upon completion of the winding, of arresting the rotation of the reels.

A locking mechanism seen at 18 in both FIGS. 1 and 2 functions to hold the handcart 10 against displacement with respect to the driving and braking mechanism 16 during the reeling of the fastener tapes F. A feed mechanism 20, FIG. 1, is effective to feed the fastener tapes F toward the reels 14 so as to prevent the exertion of any great tension on the fastener tapes as they are reeled.

Given hereunder is a more extensive discussion of the above noted carriage or handcart 10, reel assembly 12, driving and braking mechanism 16, locking mechanism 18, and feed mechanism 20, in that order, under the respective headings. The operational description of the complete apparatus will follow the discussion of the listed components.

Carriage

As will be seen from both FIGS. 1 and 2, the carriage or handcart 10 includes a generally boxlike frame 22 having two pairs of wheels 24 and 26 on its underside. Preferably, and as shown, the first pair of wheels 24 are casters capable of swiveling about an axis perpendicular to the wheel axis. Formed on one end of the frame 22, an inverted U shaped handle 28 is to be gripped in moving the handcart 10 between the desired locations. The frame 22 has also rigidly mounted thereon an upstanding shaft 30 which mostly extends upwardly therefrom. The upstanding shaft 30 serves to rotatably support the reels 14 of the reel assembly 12 to be detailed subsequently.

Reel Assembly

As shown also in FIGS. 1 and 2, the four reels 14 of the reel assembly 12 are all mounted on the upstanding shaft 30, each via a pair of bearings 32, for rotation independently of one another. Being capable of independent rotation, the reels 14 may be driven either successively or altogether. Thus, for instance, the fastener tapes F may be wound on the successive reels 14, from the lowermost one upward, or simultaneously on two, three or all of the reels.

Each reel 14 comprises a core portion 34 in the form of a hollow cylinder, which is sleeved upon the upstanding shaft 30 via the bearings 32, and a disklike flange 36 formed on the bottom end of the core portion 34. As required or desired, each reel 14 may be provided with another flange on the other end of the core portion 34.

The upstanding shaft 30 has a threaded upward extension 38 protruding from the topmost reel 14. A wheel-like retainer 40 is mounted on this upward shaft extension 38 for holding the reels 14 against detachment from the shaft 38. The retainer 40 is itself held in position by an overlying nut 42 in threaded engagement with the shaft extension 38.

Driving and Braking Mechanism

An inspection of FIG. 1 will reveal that the driving and braking mechanism 16 comprises four sets of driving and braking means, all supported by an upright standard 44, for individually driving and braking the four reels 14 of this particular embodiment. As will be readily understood, however, only one set of driving and braking means, movable up and down with respect to the standard 44, could be provided if only one reel is to be driven and braked at one time.

The four illustrated sets of driving and braking means can be essentially identical in construction. Only one set of such means will therefore be described in detail, it being understood that the same description substantially applies to each of the other sets.

Figure 3:
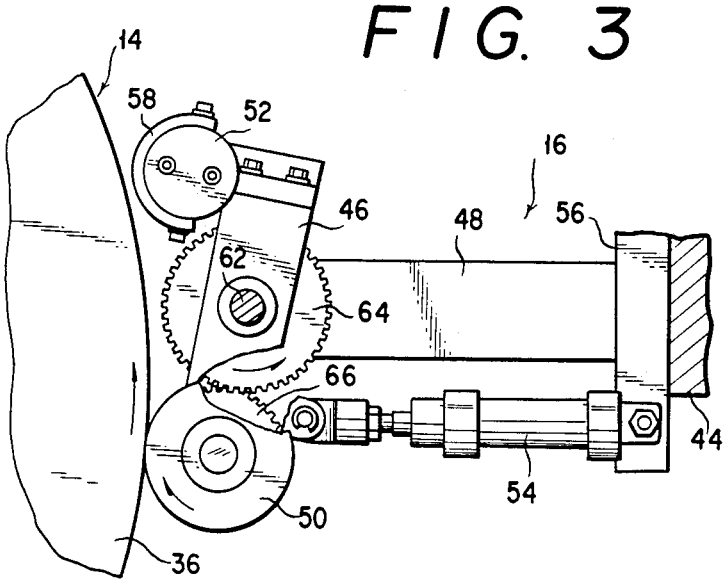
FIG. 3 is an enlarged, fragmentary top plan, with parts shown broken away to reveal other parts, of the driving and braking mechanism of the apparatus of FIG. 1, with the driving and braking mechanism being shown conditioned for driving a reel of the reel assembly.
Figure 4:
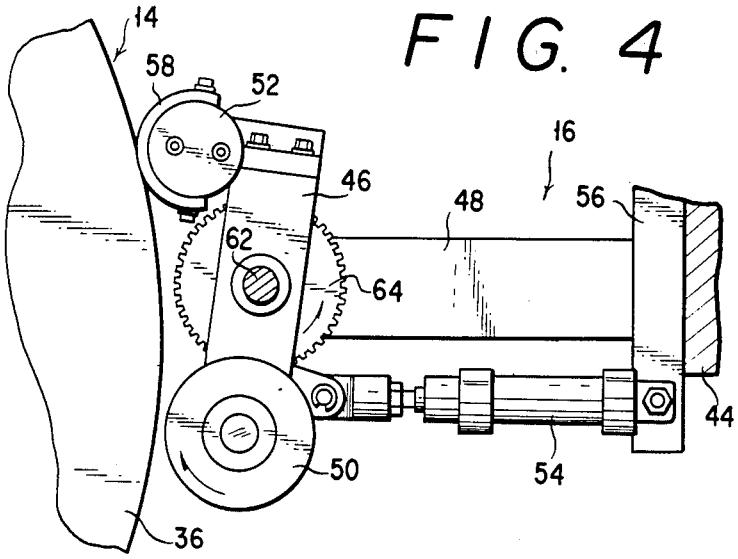
FIG. 4 is a view similar to FIG. 3 except that the driving and braking mechanism is shown conditioned for braking the reel.

As illustrated on an enlarged scale in FIGS. 3 and 4, the representative set of driving and braking means comprises a carrier arm 46 pivoted at a midpoint thereof on the distal end of a bracket 48 proximally secured to the standard 44. Thus the carrier arm 46 is capable of oscillation, or bidirectional swinging motion, on the bracket 48 about an axis parallel to the common axis of the reels 14. Mounted on the opposite ends of the carrier arm 46 are a drive roll 50 and a brake 52 for driving and braking, respectively, the associated reel 14 via its flange 36.

For bidirectionally swinging the carrier arm 46, a linear actuator 54 is operatively coupled at one end to the carrier arm and at the other end to a cross arm 56 rigidly mounted on the bracket 48. The actuator 54 is herein shown as an air cylinder, althrough it could be a hydraulic cylinder or a solenoid depending upon each intended application of the apparatus. The extension of the air cylinder 54 results in the swinging of the carrier arm 46 in a clockwise direction, as viewed in FIG. 3, with the result that the drive roll 50 is urged into driving contact with the periphery of the reel flange 36 for driving the associated reel 14 in the arrow marked direction. Upon contraction of the air cylinder 54, the carrier arm 46 is swung in a counterclockwise direction, with the result that the drive roll 50 is moved out of contact with the reel flange 36 and, instead, the brake 52 is forced into braking contact therewith, as illustrated in FIG. 4.

Preferably, the drive roll 50 should be covered with a sleeve of rubber or like material capable of offering high frictional resistance to the rotation of the reel 14. Being moved into and out of frictional contact with the reel flange 36, the drive roll 50 can be in constant rotation during the operation of this apparatus. The reel 14 will then be set into rotation immediately upon movement of the drive roll 50 into frictional contact with its flange 36.

The brake 52 can take the form of a short, upstanding cylinder fixedly mounted on the carrier arm 46 and having an antifriction facing 58 for direct contact with the periphery of the reel flange 36. The facing 58 can be of any such material as rubber, leather, or antifriction fabric and should be replaceably attached to the cylinder as by screws.

The driving and braking mechanism 16 further comprises drive means for independently imparting rotation to each drive roll 50. The drive means include an electric drive motor 60, FIG. 1, mounted upstandingly on each carrier arm 46. The drive motor 60 has an output shaft 62, FIGS. 3 and 4, rotatably extending downwardly through the carrier arm 46 and rigidly coupled to a drive gear 64. This drive gear is in mesh with a driven gear 66 which in turn is coupled to the drive roll 50 for joint rotation therewith. Thus the rotation of the drive motor 60 is transmitted to the drive roll 50 via the intermeshing gears 64 and 66. Of course, a belt or chain drive could be employed instead of the exemplified gear drive for driving the drive roll 50.

The drive motor 60 in use in this particular embodiment of the invention must be capable of controllably varying the revolving speed of the associated reel 14 with a change in the diameter of the winding of the fastener tape F on the reel. The fastener tape F must be fed at a constant speed through the heat setting station where the coating on the tape is cured. Should the reel 14 be driven at a constant peripheral speed, the fastener tape F would be wound thereon at a progressively higher speed with an increasing diameter of the tape winding on the reel. Accordingly, in order to permit the fastener tape to be fed through the heat setting station at a constant speed, the reel must be driven at a gradually decreasing speed with an increase in the diameter of the tape winding on the reel. A pulse motor or even a hydraulic motor might therefore be employed only if it can control the revolving speed of the reel as in the foregoing.

Locking Mechanism

Figure 5:
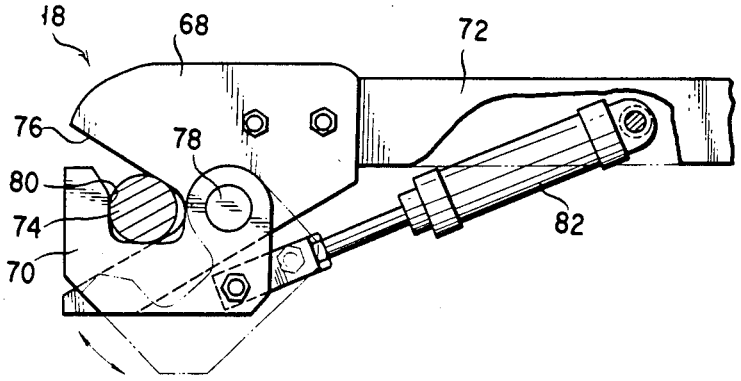
FIG. 5 is an enlarged top plan, with a part shown broken away to reveal other parts, of the locking mechanism of the apparatus of FIG. 1.

The locking mechanism 18 is shown in both FIGS. 1 and 2 and on an enlarged scale in FIG. 5. It comprises a fixed gripping jaw 68 and movable gripping jaw 70 which are built on the distal end of a cantilever 72 affixed to the upstanding standard 44. When the handcart 10 is held in place with respect to the driving and braking mechanism 16 as shown in FIG. 1, the cantilever 72 project into the hollow frame 22 of the handcart. The upstanding shaft 30 erected on the handcart frame 22 has a downward extension 74 to be gripped by the pair of gripping jaws 68 and 70.

Rigidly fastened to the cantilever 72, the fixed gripping jaw 68 has a V shaped notch 76 for receiving the shaft extension 74. The movable gripping jaw 70 is pin jointed at 78 to the fixed gripping jaw 68 for pivotal motion relative to the same about an parallel to the axis of the upstanding shaft 30. Generally U shaped, the movable gripping jaw 70 has a recess 80 for positive engagement with the shaft extension 74 when the latter is received in the deepest part of the notch 76 of the fixed gripping jaw 68.

Also included in the locking mechanism 18 is a linear actuator such as a fluid actuated cylinder 82, preferably pneumatic, operatively coupled between the movable gripping jaw 70 and the cantilever 72. The shaft extension 74 is gripped by the pair of gripping jaws 68 and 70 upon extension of the fluid actuated cylinder 82, as indicated by the solid lines in FIG. 5. with the shaft extension 74 thus locked by the locking mechanism 18, the handcart 10 (or at least the axis of the stacked reels 14) can be restrained from displacement relative to the driving and braking mechanism 16 during the reeling of the fastener tapes F. The fluid actuated cylinder 82 may be contracted upon completion of the reeling operation. The movable gripping jaw 70 will then pivot away from the fixed gripping jaw 68, as indicated by the dashed lines in FIG. 5, thereby unlocking the shaft extension 74.

All that must be done by the locking mechanism 18 is to lock the handcart 10, or at least the fixed shaft 30 thereon, against displacement with respect to the driving and braking mechanism 16 during the reeling of the fastener tapes F. It is therefore envisaged within the scope of this invention to attain the same objective by, for example, braking the wheels 24 and 26 of the handcart 10 or by firmly holding the handcart itself, instead of by gripping the extension 74 of the fixed shaft 30 as in the illustrated embodiment.

Feed Mechanism

As illustrated in FIG. 1, the feed mechanism 20 comprises a pair of feed rolls 84 disposed on both sides of a predetermined path of each fastener tape F from the heat setting station to the reeling apparatus of this invention. One of each pair of feed rolls 84 is coupled directly to a drive motor 86 to be driven thereby. Passing between the pair of feed rolls 84, each fastener tape F is frictionally fed toward the reeling apparatus at a constant speed in conformity with the rate at which the fastener tape is wound on one of the reels 14.

Were it not for the feed mechanism 20, each fastener tape F would be tensioned on being wound on one of the reels 14 by its forced rotation by the drive roll 50. The fastener tape would then be coiled so tightly on the reel that its protuberant elements such as loops or hooks might be distorted, thereby impairing the quality of the end products. This possibility can be precluded by forcibly feeding each fastener tape F by the feed mechanism 20 so as to avoid the exertion of any undesired degree of tension on the fastener tape being reeled.

Operation

In the use of the reeling apparatus constructed as in the foregoing, the handcart 10 with the four empty reels 14 may be moved over to the preassigned position with respect to the driving and braking mechanism 16. It is understood that the air cylinder 82 of the gripping mechanism 18 is now contracted, holding the movable gripping jaw 70 away from the fixed gripping jaw 68. The handcart 10 may be so positioned that the downward extension 74 of the fixed shaft 30 thereon is received in the notch 76 in the fixed gripping jaw 68 of the locking mechanism 18. Then the air cylinder 82 may be extended for gripping the shaft extension 74 between the pair of gripping jaws 68 and 70. Now the reel assembly 12 has its axis locked against displacement relative to the driving and braking mechanism 16.

If two fastener tapes F are to be reeled at one time as shown in FIG. 1, the extremities of these tapes may be anchored to the cylindrical cores 34 of two reels 14 in any convenient manner. Then the air cylinders 54 of the driving and braking means associated with the two selected reels 14 may be extended to pivot the carrier arms 46 in the direction for moving the drive rolls 50 into driving contact with the peripheries of the reel flanges 36, as illustrated in FIG. 3. The brakes 52 on these carrier arms 46 will then move out of contact with the reel flanges 36.

If the drive rolls 50 have already been set into rotation by the associated drive motors 60, the two desired reels 14 will start rotation immediately upon forced contact of these drive rolls with their flanges 36. The fastener tapes F will be wound on the reels 14 at a constant rate as the drive motor 60 drives them at a progressively decreasing speed.

Upon full loading of the reels 14 with the fastener tapes F, the air cylinders 54 may be contracted to move the drive rolls 50 out of contact with the reel flanges 36, as shown in FIG. 4. Almost concurrently with the movement of the drive rolls 50 away from the reel flanges 36, the brakes 52 will make frictional contact therewith thereby immediately arresting the rotation of the reels 14.

Then the fastener tapes F may be coiled on two other reels 14 by the repetition of the foregoing procedure.

If the reels 14 were not braked immediately upon completion of the winding, the coiled fastener tapes might be partly unwound or loosened through the inertial rotation of the reels, since the end portions of the fastener tapes might be flung out centrifugally. Such partial unwinding or loosening of the coiled tapes would make difficult the subsequent transportation and handling of the reels. The present invention overcomes the difficulties by immediately braking the reels 14 upon completion of the winding.

While the apparatus in accordance with the invention has been hereinbefore disclosed as adapted specifically for reeling surface type fastener tapes, such disclosure merely represents one possible application of the invention as many other applications and adaptations are possible within the scope of this invention. Also, various changes may be made in the details of the above disclosed embodiment without departing from the scope of the invention. For instance, the reel assembly 12 may be mounted not on the handcart 10 but on any other form of carriage such as that suspended from, and movable along, overhead railing.

What is claimed is:

1. An apparatus for reeling an elongate strip of flexible material, comprising:

(a) a reel rotatable about a predetermined axis for winding the strip thereon, the reel having a cylinder and at least one flange formed on one end of the cylinder for joint rotation therewith;

(b) a driving and braking mechanism disposed in a predetermined location for imparting rotation to the reel in order to cause the strip to be wound on the reel, and for arresting the rotation of the reel upon completion of the winding of the strip thereon;

wherein said driving and braking mechanism comprises:

(c) a carrier arm pivoted at a midpoint thereof for oscillation about an axis parallel to the axis of the reel;

(d) a drive roll mounted on one end of the carrier arm for rotation about an axis parallel to the axis of the reel, the drive roll being movable into and out of driving engagement with the periphery of the flange of the reel with the oscillation of the carrier arm;

(e) drive means for imparting rotation to the drive roll;

(f) a brake mounted on the other end of the carrier arm for movement into and out of braking engagement with the periphery of the flange of the reel with the oscillation of the carrier arm; and (g) an actuator for oscillating the carrier arm in order to move the drive roll and the brake into and out of driving and braking engagement, respectively, with the flange of the reel.

2. The reeling apparatus as recited in claim 1, wherein said drive means comprises:

(a) a drive motor on the carrier arm; and (b) means on the carrier arm for transmitting the rotaton of the drive motor to the drive roll.

3. The reeling apparatus as recited in claim 1, as for the transportation of such a strip from one processing station to another, further comprising:

(a) a carriage for mounting the reel thereon and transporting a reeled strip;

(b) fixed supporting means oscillatably supporting the carrier arm thereto through a pivot shaft mounted thereon; and (c) a locking mechanism for holding at least the axis of the reel in position with respect to the driving and braking mechanism during the reeling of the strip.

4. The reeling apparatus as recited in claim 3, wherein said reel is rotatably mounted on a fixed shaft on the carriage, and comprises a cylindrical core rotatably mounted on the carriage and at least one flange formed on the core for joint rotation therewith, and wherein said locking mechanism comprises:

(a) a fixed gripping jaw rigidly mounted in a fixed position with respect to the driving and braking mechanism;

(b) a movable gripping jaw movable with respect to the fixed gripping jaw and coacting therewith for gripping and releasing the fixed shaft on which the reel is mounted; and (c) an actuator for moving the movable pripping jaw with respect to the fixed gripping jaw so as to cause the jaws to grip and release the fixed shaft.

5. An apparatus capable of reeling a plurality or elongate strips of flexible material, as for the transportation of such strips from one processing station to another, comprising:

(a) a carriage for transporting reeled strips;

(b) a plurality of reels rotatably and coaxially mounted on the carriage for winding the strips thereon;

(c) a driving and braking mechanism disposed in a predetermined location for imparting rotation to the reels in order to cause the strips to be wound thereon, and for arresting the rotation of the reels upon completion of the winding of the strips thereon;

(d) a locking mechanism for holding at least the axis of the reels in position with respect to the driving and braking mechanism during the reeling of the strips;

wherein each of said reels comprises a cylindrical core mounted on the carrier for independent rotation, and at least one flange formed on the cylindrical core for joint rotation therewith, and wherein said driving and braking mechanism comprises:

(e) fixed support means;

(f) a plurality of carrier arms each medially pivoted on the support means for oscillation about an axis parallel to the axis of the reels;

(g) a drive roll mounted on one end of each carrier arm for rotation about an axis parallel to the axis of the reels, each drive roll being movable into and out of driving engagement with the peripherey of the flange of one reel with the oscillation of the associated carrier arm;

(h) drive means for imparting rotation to each drive roll;

(i) a brake mounted on the other end of each carrier arm for movement into and out of braking engagement with the periphery of the flange of one reel with the oscillation of the associated carrier arm; and (j) an actuator for oscillating each carrier arm with respect to the support means in order to move the drive roll and the brake on each carrier arm into and out of driving and braking engagement, respectively, with the flange of one reel.

6. The reeling apparatus as recited in claim 5, wherein said drive means comprises:

(a) a drive motor on the carrier arm; and (b) means on the carrier arm for transmitting the rotation of the drive motor to the drive roll.

7. The reeling apparatus as recited in claim 5, wherein said reels are rotatably mounted on a fixed shaft on the carriage, and wherein said locking mechanism comprises:

(a) a fixed gripping jaw rigidly mounted in a fixed position with respect to the driving and braking mechanism;

(b) a movable gripping jaw movable with respect to the fixed gripping jaw and coacting therewith for gripping and releasing the fixed shaft on which the reels are mounted; and (c) an actuator for moving the movable gripping jaw with respect to the fixed gripping jaw so as to cause the jaws to grip and release the fixed shaft.

8. The reeling apparatus as recited in claim 5, wherein said reels are rotatably and removably mounted on a fixed shaft on the carriage.

9. The reeling apparatus as recited in claim 5, wherein said carriage is a handcart.

* * * * *